US011306276B2

(12) United States Patent
Rightmire et al.

(10) Patent No.: US 11,306,276 B2
(45) Date of Patent: Apr. 19, 2022

(54) DETERGENT COMPOSITION CONTAINING A TETRAPOLYMER

(71) Applicant: ECOLAB USA INC., Saint Paul, MN (US)

(72) Inventors: Kelly Anne Rightmire, Saint Paul, MN (US); Carter M. Silvernail, Saint Paul, MN (US)

(73) Assignee: ECOLAB USA INC., Saint Paul, MN (US)

( * ) Notice: Subject to any disclaimer, the term of this patent is extended or adjusted under 35 U.S.C. 154(b) by 0 days.

(21) Appl. No.: 16/947,568

(22) Filed: Aug. 6, 2020

(65) Prior Publication Data

US 2021/0040419 A1 Feb. 11, 2021

Related U.S. Application Data

(60) Provisional application No. 62/883,222, filed on Aug. 6, 2019.

(51) Int. Cl.

| | |
|---|---|
| ***C11D 1/72*** | (2006.01) |
| ***C11D 1/722*** | (2006.01) |
| ***C11D 3/06*** | (2006.01) |
| ***C11D 3/08*** | (2006.01) |
| ***C11D 3/10*** | (2006.01) |
| ***C11D 3/37*** | (2006.01) |

(Continued)

(52) U.S. Cl.

CPC ..... *C11D 3/3765* (2013.01); *C11D 1/722* (2013.01); *C11D 3/044* (2013.01); *C11D 3/10* (2013.01); *C11D 3/1213* (2013.01); *C11D 3/201* (2013.01); *C11D 3/2065* (2013.01)

(58) Field of Classification Search

CPC ..... C11D 1/72; C11D 1/722; C11D 3/044; C11D 3/06; C11D 3/08; C11D 3/10; C11D 3/2075; C11D 3/3746; C11D 3/3757; B08B 3/04

See application file for complete search history.

(56) References Cited

U.S. PATENT DOCUMENTS

| | | | |
|---|---|---|---|
| 3,048,548 | A | 8/1962 | Martin et al. |
| 3,334,147 | A | 8/1967 | Brunelle et al. |

(Continued)

FOREIGN PATENT DOCUMENTS

| | | | |
|---|---|---|---|
| CN | 104045173 | A | 9/2014 |
| WO | 2015070117 | A1 | 5/2015 |

OTHER PUBLICATIONS

International Searching Authority in connection with PCT/US2020/045102 filed Aug. 6, 2020, "The International Search Repot and the Written Opinion of the International Searching Authority, or the Declaration", 21 pages, dated Oct. 27, 2020.

(Continued)

*Primary Examiner* — Brian P Mruk

(74) *Attorney, Agent, or Firm* — McKee, Voorhees & Sease, PLC

(57) ABSTRACT

Detergent compositions effective for controlling hard water scale accumulation are described herein. In particular, the compositions combine a tetrapolymer with an alkaline composition to effectively prevent or remove calcium carbonate scale formations. Methods of employing the detergent compositions and of preventing scale accumulation are provided for use in alkaline warewash and other applications.

20 Claims, 8 Drawing Sheets

(51) Int. Cl.

| | |
|---|---|
| ***B08B 3/04*** | (2006.01) |
| ***C11D 3/04*** | (2006.01) |
| ***C11D 3/12*** | (2006.01) |
| ***C11D 3/20*** | (2006.01) |

(56) References Cited

U.S. PATENT DOCUMENTS

| | | | |
|---|---|---|---|
| 3,929,678 | A | 12/1975 | Laughlin et al. |
| 4,426,362 | A | 1/1984 | Copeland et al. |
| 4,687,121 | A | 8/1987 | Copeland |
| 4,690,305 | A | 9/1987 | Copeland |
| RE32,763 | E | 10/1988 | Fernholtz et al. |
| RE32,818 | E | 1/1989 | Fernholtz et al. |
| 4,826,661 | A | 5/1989 | Copeland et al. |
| 5,018,577 | A | 5/1991 | Pardue et al. |
| 5,023,000 | A | 6/1991 | Kneller et al. |
| 5,085,794 | A | 2/1992 | Kneller et al. |
| 5,656,646 | A | 8/1997 | Perner et al. |
| 5,658,993 | A | 8/1997 | Denzinger et al. |
| 6,172,028 | B1 | 1/2001 | Baur et al. |
| 6,207,780 | B1 | 3/2001 | Stockhausen et al. |
| 6,572,789 | B1 | 6/2003 | Yang et al. |
| 6,962,898 | B2 | 11/2005 | Kessler et al. |
| 7,192,911 | B2 | 3/2007 | Sunder et al. |
| 8,092,613 | B2 | 1/2012 | Strothoff et al. |
| 8,093,196 | B2 | 1/2012 | Seebeck et al. |
| 8,163,100 | B2 | 4/2012 | Karagianni et al. |
| 8,262,804 | B2 | 9/2012 | Weber et al. |
| 8,497,318 | B2 | 7/2013 | Laubender et al. |
| 8,623,151 | B2 | 1/2014 | Olson et al. |
| 8,668,779 | B2 | 3/2014 | Cooper et al. |
| 8,729,006 | B2 | 5/2014 | Miralles et al. |
| 8,748,364 | B2 | 6/2014 | Silvernail |
| 8,889,048 | B2 | 11/2014 | Stolte et al. |
| 9,127,236 | B2 | 9/2015 | Silvernail et al. |
| 9,139,800 | B2 | 9/2015 | Monsrud et al. |
| 9,255,242 | B2 | 2/2016 | Olson et al. |
| 9,598,664 | B2 | 3/2017 | Yang et al. |
| 9,670,435 | B2 | 6/2017 | Detering et al. |
| 9,765,286 | B2 | 9/2017 | Silvernail et al. |
| 9,840,683 | B2 | 12/2017 | Silvernail et al. |
| 10,316,272 | B2 | 6/2019 | Dotzauer et al. |
| 2013/0252871 | A1* | 9/2013 | Olson ..... C11D 7/12 510/238 |
| 2016/0115051 | A1* | 4/2016 | Standish ..... C08F 222/02 210/698 |
| 2017/0101601 | A1 | 4/2017 | Vockenroth et al. |
| 2018/0215638 | A1 | 8/2018 | Standish |

OTHER PUBLICATIONS

Radical Polymers, "Initia 585", 2 page handout 2014.

* cited by examiner

| | | | | | |
|---|---|---|---|---|---|
| | | | | | G |
| | | | | G | |
| | | | G | | |
| | | G | | | |
| | G | | | P | |
| G | | | | | |

*Fig. 17*

DETERGENT COMPOSITION CONTAINING A TETRAPOLYMER

CROSS-REFERENCE TO RELATED APPLICATIONS

This application claims priority under 35 U.S.C. § 119 to provisional application Ser. No. 62/883,222, filed Aug. 6, 2019, the entirety of which is herein incorporated by reference in its entirety.

FIELD OF THE INVENTION

The present disclosure relates to detergent compositions effective for controlling hard water scale accumulation, particularly preventing, and/or removing calcium carbonate scale formations. In particular, detergent compositions employing a polymaleic acid tetrapolymer and combined with alkali metal carbonate and/or alkali metal hydroxide are provided. Methods employing the detergent compositions and preventing scale accumulation are provided for use in alkaline warewash and other applications.

BACKGROUND OF THE INVENTION

Scale comprises the inorganic mineral components of water that will precipitate and form deposits. Scale can precipitate as fine scales of hard insoluble crystalline solids and be detrimental to systems and equipment surfaces (e.g. glass, plastic, and/or metal surfaces), thus inhibiting the soil removal efficacy of detergent compositions and any other compositions used in tandem with detergents (e.g. rinse aids, antimicrobials, etc.). Alkaline detergents are commonly used in industrial warewash and other settings. In the presence of hard water, effective cleaning performance is difficult due to the deposition of calcium carbonate scale onto hard surfaces, such as glass, plastic, and metal.

To address calcium carbonate scaling, many existing detergents utilizes polymeric threshold agents, chelants, and/or water conditioning agents. However, many of these compositions use one or more phosphorous-based compounds. Increasingly phosphorous is less preferred in view of safer and more sustainable detergent compositions. This has led to the development of compositions containing alternative complexing agents, builders, threshold agents, corrosion inhibitors, and the like, which are used instead of predominantly phosphorous containing compounds. However, the materials in many of these compositions are expensive and/or must be present in relatively high quantities to ensure effective scale inhibition. Further, many are not as effective as traditional scale inhibitors.

As a result, there is a need to develop environmentally sustainable detergent compositions which effectively prevent the formation of and/or remove calcium carbonate scale in highly alkaline conditions.

There is a further need for scale-inhibiting detergent compositions which function effectively even at low concentrations of scale inhibitor.

Finally, there is a need to develop scale-inhibiting detergent compositions which are cost-effective.

Other needs, objects, advantages, or features of the present disclosure will become apparent from the following specification taken in conjunction with the accompanying drawings.

BRIEF SUMMARY OF THE INVENTION

In an aspect, the disclosure is directed to a scale inhibiting detergent composition comprising one or more sources of alkalinity, one or more surfactants, and a maleic acid tetrapolymer. According to this embodiment, the one or more sources of alkalinity may include, without limitation, sodium hydroxide, potassium hydroxide, lithium hydroxide, sodium silicate, sodium metasilicate, potassium silicate, potassium metasilicate, sodium carbonate, potassium carbonate, sodium bicarbonate, potassium bicarbonate, sodium sesquicarbonate, potassium sesquicarbonate, sodium borate, potassium borate, or a combination thereof. According to this embodiment, the maleic acid tetrapolymer may, for example, include over 50% maleic acid, up to about 5% of maleic anhydride, up to about 50% of acrylic acid, and up to about 50% of a 2-carbon alkane group. Consistent with this embodiment, the surfactant may include a nonionic, anionic, amphoteric, zwitterionic and/or cationic surfactant. Where a nonionic surfactant is included, the nonionic surfactant may comprise, for example, a polyoxyethylene-polyoxypropylene block copolymer.

In an aspect, the composition may further comprise one or more water conditioning agents, wherein the one or more water conditioning agents are phosphates, phosphonates, aminocarboxylic acids, organic water conditioning agents, inorganic water conditioning agents, polycarboxylic acids or a combination thereof.

In an embodiment, the composition may further comprise a carrier, wherein the carrier may include, without limitation, water, an alcohol, a water-soluble diol, or a combination thereof. In an embodiment, where the carrier is water, the water may be present in an amount of between about 10 wt. % to about 60 wt. %.

In an aspect, the composition may further comprise one or more additional functional ingredients. The additional functional ingredients may comprise, without limitation, fillers, additional surfactants, corrosion inhibitors, additional water conditioning agents, hardening agents, bleaching agents, defoaming agents, anti-redeposition agents, stabilizing agents, dispersants, enzymes, thickeners, fragrances, dyes, or a combination thereof.

In a further aspect, the disclosure is directed to a scale inhibiting detergent composition comprising between about 5 wt. % to about 80 wt. % of one or more sources of alkalinity, between about 5 wt. % to about 50 wt. % of a nonionic surfactant, and between about 1 wt. % to about 15 wt. % of a maleic acid tetrapolymer, wherein the maleic acid tetrapolymer includes over 50% maleic acid, up to about 5% of maleic anhydride, up to about 50% of acrylic acid, and up to about 50% of a 2-carbon alkane group.

In an embodiment, the nonionic surfactant may comprise, for example, a polyoxyethylene-polyoxypropylene block copolymer.

In an aspect, the composition may further comprise between about 0.001 wt. % to about 5 wt. % of a corrosion inhibitor, and wherein the corrosion inhibitor is aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, zinc salicylate or a combination thereof.

In an aspect, the composition may further comprise between about 0.01 wt. % to about 8 wt. % of a carrier. In an embodiment, the carrier may comprise, without limitation, water, ethanol, n-propanol, isopropanol, pentylene glycol, hexylene glycol, propylene glycol or a combination thereof.

In an aspect, the composition may further comprise between about 0.5 wt. % to about 10 wt. % of a filler. In an embodiment, the filler may comprise, without limitation, sodium sulfate, sodium chloride, a starch, a sugar, a $C_1$-$C_{10}$ alkylene glycol, or a combination thereof.

In an aspect, the composition may further comprise between about 1 wt. % to about 55 wt. % of one or more polycarboxylic acid polymers.

In an embodiment, the composition may be a pressed solid, a cast solid, an extruded solid, or a flowable solid. In a further embodiment, the composition may be a liquid concentrate. In an embodiment, the composition is provided as a liquid concentrate, the liquid concentrate may be diluted to form a use solution.

In an aspect, the disclosure is directed to a method of preventing scale formation on a surface comprising providing a scale inhibiting composition comprising one or more sources of alkalinity, one or more water conditioning agents, and a maleic acid tetrapolymer; and thereafter contacting the scale inhibiting composition with a surface.

In an aspect, the surface comprises metal, plastic, and/or glass. In a further aspect, the surface is a hard surface comprising a grill, oven, dishware, flatware, surgical instrument, vehicle, floor, countertop, table, or a combination thereof.

While multiple embodiments are disclosed, still other embodiments will become apparent to those skilled in the art from the following detailed description, which shows and describes illustrative embodiments. Accordingly, the drawings and detailed description are to be regarded as illustrative in nature and not restrictive.

BRIEF DESCRIPTION OF THE DRAWINGS

FIG. 17 is a diagram of the Raburn rack used in the 100 cycle test, where six clean glass tumblers (as indicated by "G") were placed diagonally in a Raburn rack and one Newport 10 oz. plastic tumbler (as indicated by "P") was placed off-diagonally in the Raburn rack, and the rack was placed inside the warewash machine.

Figure 1:
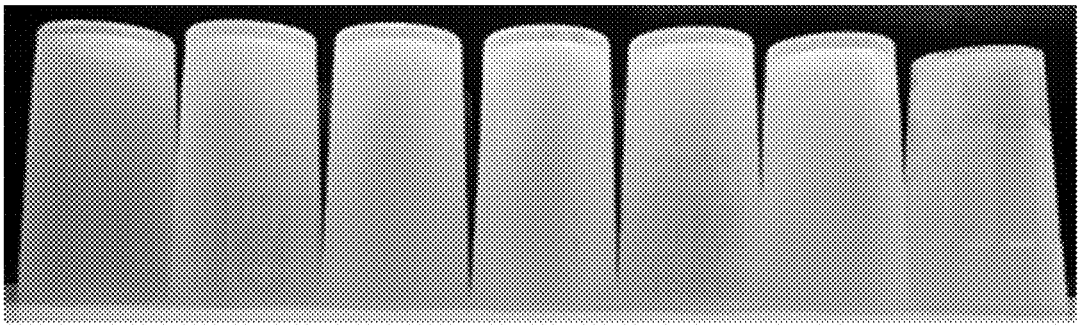
FIG. 1 depicts glass and plastic cups cleaned with a control formulation containing high levels of alkalinity, no tetrapolymer, and no calcium carbonate scale inhibitors.
Figure 2:
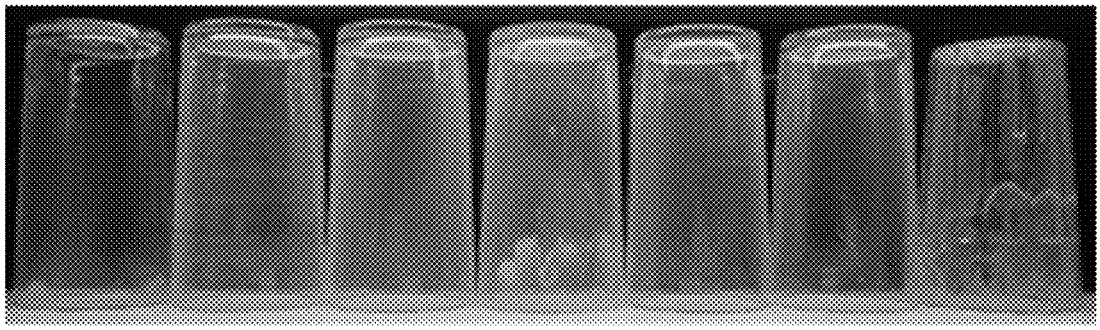
FIG. 2 shows glass and plastic cups cleaned with Solid Detergent 1, a solid detergent formulation containing no tetrapolymer and a traditional calcium carbonate scale inhibitor (e.g. Acusol 448).
Figure 3:
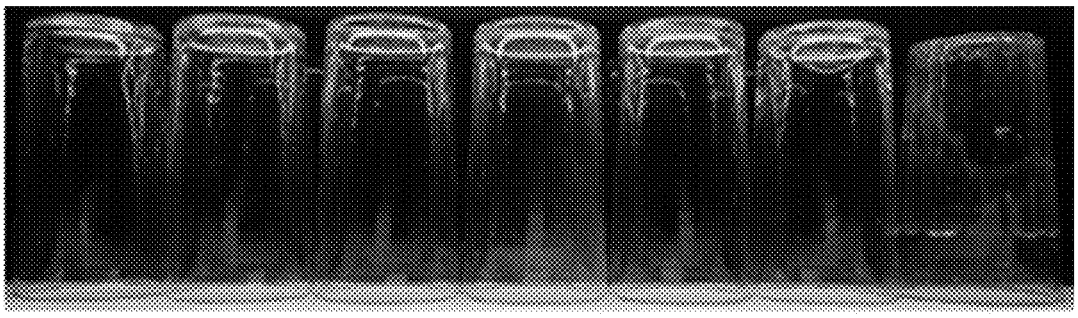
FIG. 3 shows glass and plastic cups cleaned with Solid Detergent 2, a solid detergent formulation according to the disclosure containing about 8 wt. % of the maleic acid-based tetrapolymer.
Figure 4:
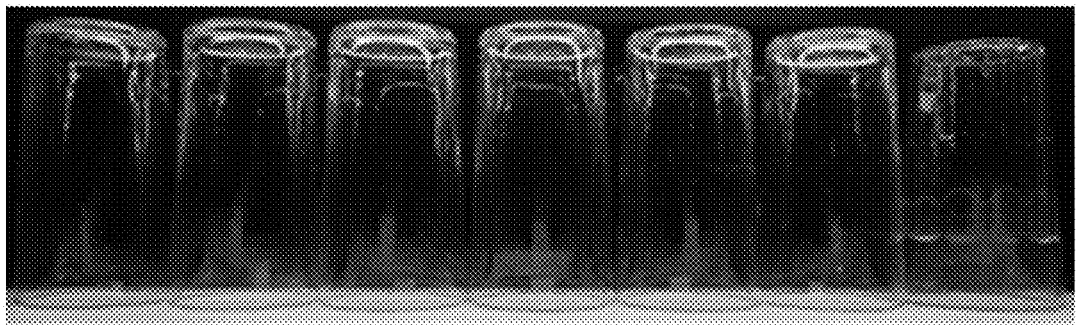
FIG. 4 depicts glass and plastic cups cleaned with Solid Detergent 3, a solid detergent formulation according to the disclosure containing about 4 wt. % of the maleic acid-based tetrapolymer.
Figure 5:
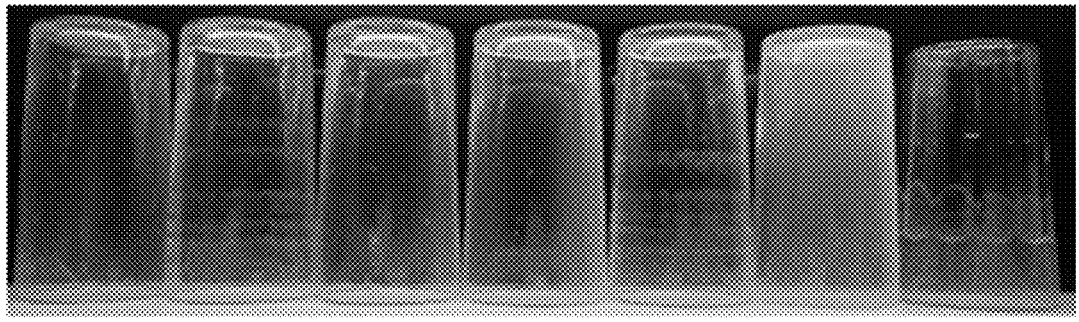
FIG. 5 shows glass and plastic cups cleaned with Solid Detergent 4, a solid detergent formulation according to the disclosure containing about 2 wt. % of the maleic acid-based tetrapolymer.
Figure 6:
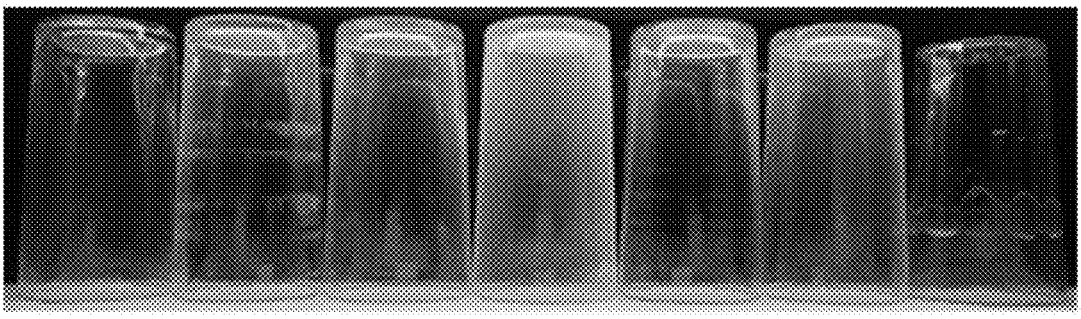
FIG. 6 depicts glass and plastic cups cleaned with Solid Detergent 5, a solid detergent formulation according to the disclosure containing about 1 wt. % of the maleic acid-based tetrapolymer.
Figure 7:
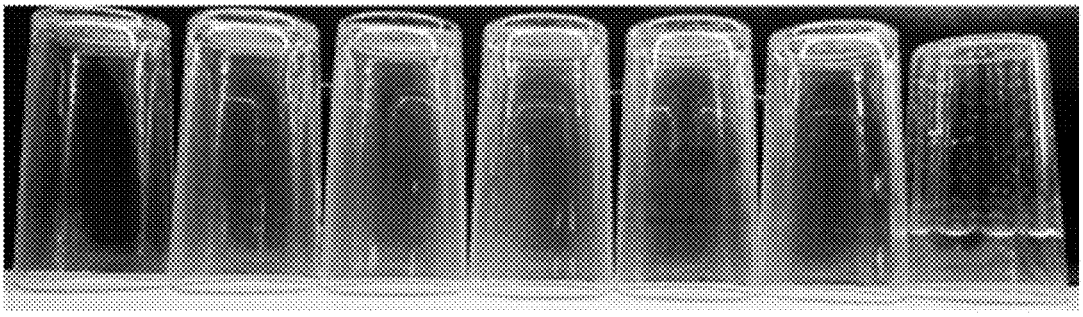
FIG. 7 shows glass and plastic cups cleaned with Solid Detergent 6, a solid detergent formulation containing no tetrapolymer at 12 wt. % of a traditional calcium carbonate scale inhibitor (e.g. a polymaleic acid homopolymer such as Belclene 200).
Figure 8:
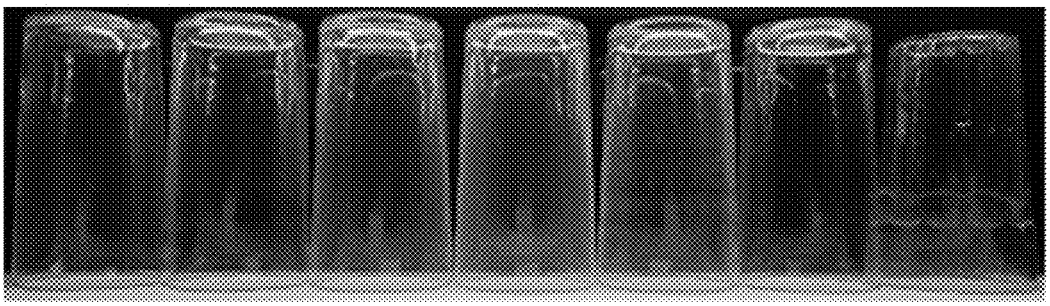
FIG. 8 depicts glass and plastic cups cleaned with Liquid Detergent 1, a liquid detergent formulation containing no tetrapolymer and a traditional calcium carbonate scale inhibitor (e.g. Acumer 1000).
Figure 9:
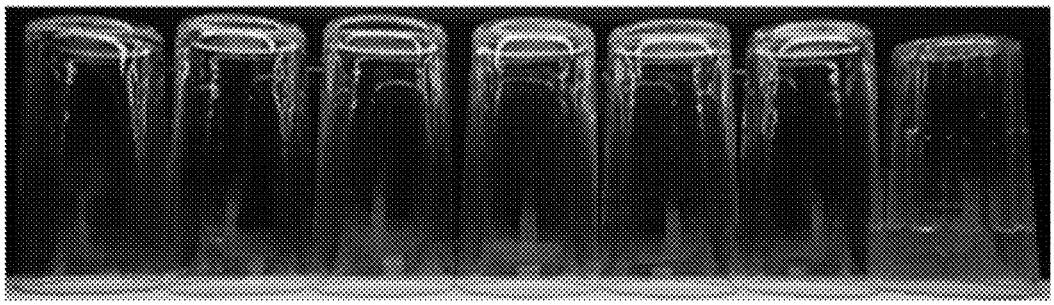
FIG. 9 depicts glass and plastic cups cleaned with Liquid Detergent 2, a liquid detergent formulation according to the disclosure containing about 1.6 wt. % of the maleic acid-based tetrapolymer.
Figure 10:
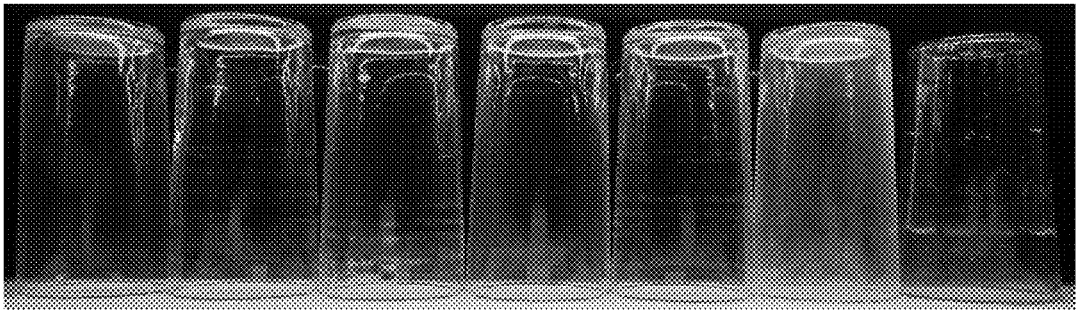
FIG. 10 shows glass and plastic cups cleaned with Solid Detergent 7, a solid detergent formulation according to the disclosure containing about 8% of the maleic acid-based tetrapolymer and no other water conditioning agents/polymers.
Figure 11:
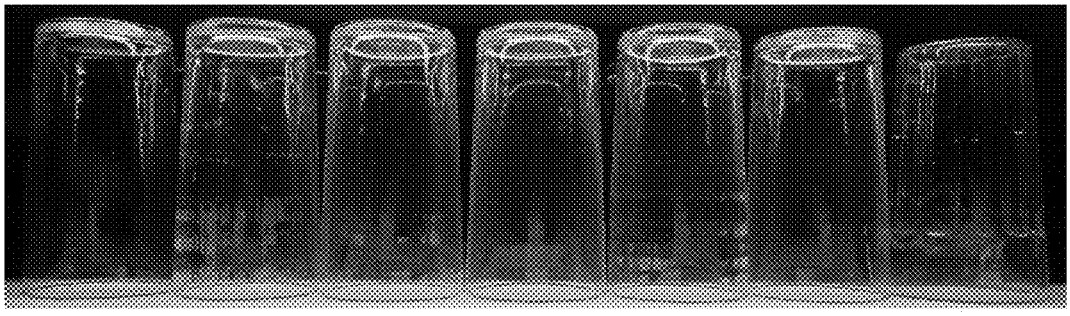
FIG. 11 shows glass and plastic cups cleaned with Liquid Detergent 3, a liquid detergent formulation according to the disclosure containing about 8% of the maleic acid based tetrapolymer and no other water conditioning agents/polymers.
Figure 12:
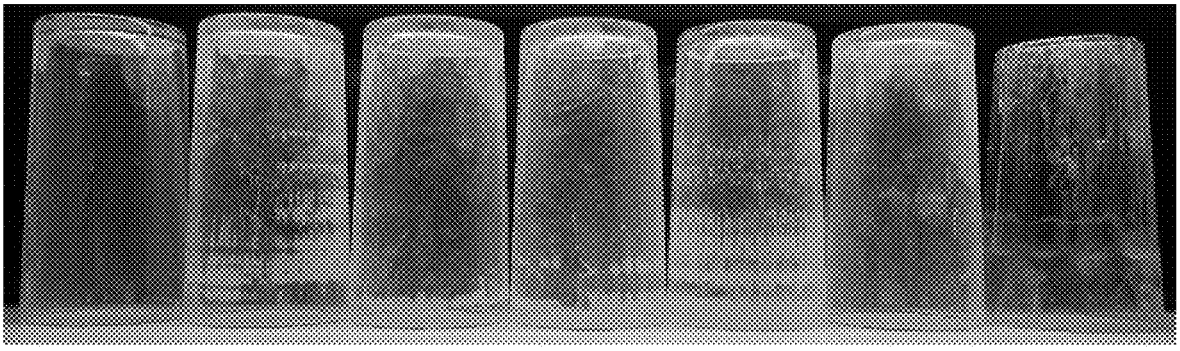
FIG. 12 shows glass and plastic cups cleaned with Liquid Detergent 4, a liquid detergent formulation according to the disclosure containing about 4% of the maleic acid-based tetrapolymer and no other water conditioning agents/polymers.
Figure 13:
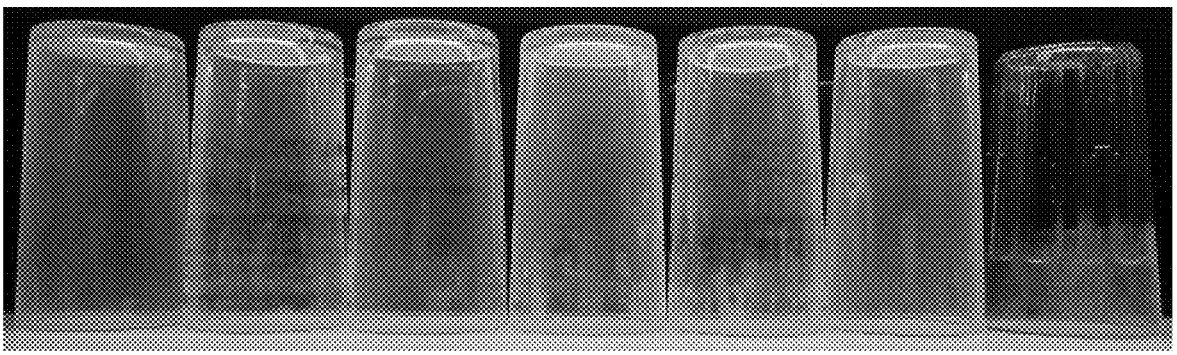
FIG. 13 depicts glass and plastic cups cleaned with Liquid Detergent 5, a liquid detergent formulation according to the disclosure containing about 1% of the maleic acid-based tetrapolymer and no other water conditioning agents/polymers.
Figure 14:
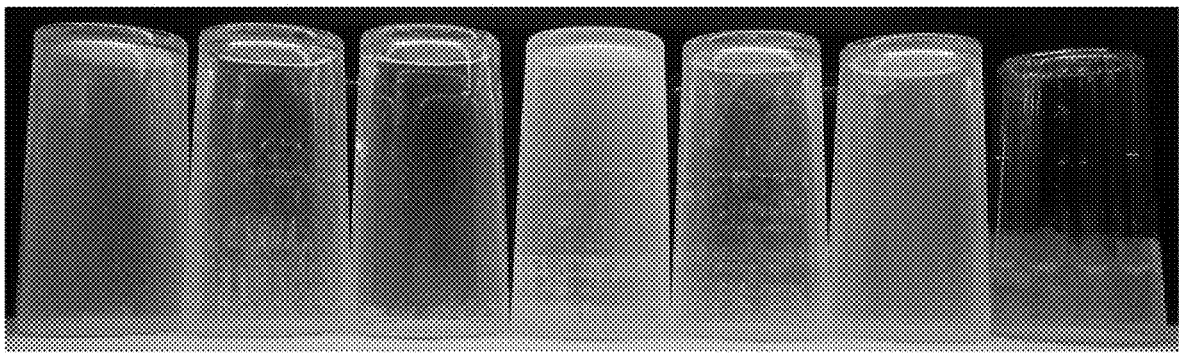
FIG. 14 shows glass and plastic cups cleaned with Solid Detergent 8, a solid detergent formulation according to the disclosure containing about 4% of the maleic acid-based tetrapolymer.
Figure 15:
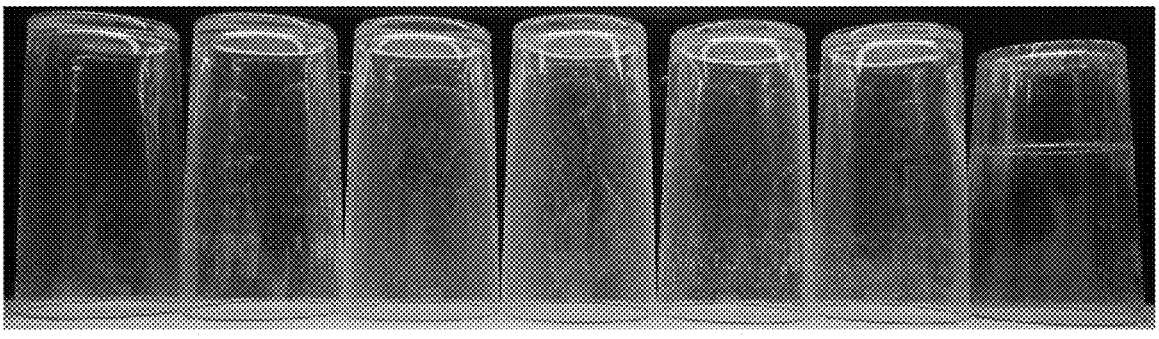
FIG. 15 depicts glass and plastic cups cleaned with Solid Detergent 8, a solid detergent formulation according to the disclosure containing 6.4% of the maleic acid-based tetrapolymer.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The compositions described herein relate to detergent compositions employing a maleic acid-based tetrapolymer as part of an alkaline detergent composition. The detergent compositions have many advantages over conventional alkali metal carbonate and/or alkali metal hydroxide detergents. For example, the detergent compositions provide effective hard water scale accumulation prevention at alkaline conditions and using low levels of scale inhibition polymer.

The embodiments described herein are not limited to particular alkaline detergent compositions, which can vary and are understood by skilled artisans. It is further to be understood that all terminology used herein is for the purpose of describing particular embodiments only and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers defining the range and include each integer within the defined range. For example, a ranged described as "between about 1 ppm and about 10 ppm" includes 1 ppm, 2 ppm, 3 ppm, 4 ppm, 5 ppm, 6 ppm, 7 ppm, 8 ppm, 9 ppm and 10 ppm."

For clarity, certain terms are first defined. Unless defined otherwise, all technical and scientific terms used herein have the same meaning as commonly understood in the field. Many methods and materials similar, modified, or equivalent to those described herein can be used in the practice of the embodiments described herein without undue experimentation, the preferred materials and methods are described herein. In describing and claiming the embodiments described herein, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

An "anti-redeposition agent" refers to a compound that helps keep suspended in water instead of redepositing onto the object being cleaned. Anti-redeposition agents are useful in the detergent compositions described herein to assist in reducing redepositing of the removed soil onto the surface being cleaned.

The term "cleaning, "as used herein, refers to performing or aiding in any soil removal, bleaching, microbial population reduction, or combination thereof.

The term "defoamer" or "defoaming agent," as used herein, refers to a composition capable of reducing the stability of foam. Examples of defoaming agents include, but are not limited to: (poly)ethylene oxide/(poly)propylene block copolymers such as those available under the name Pluronic N-3; silicone compounds such as silica dispersed in polydimethylsiloxane, polydimethylsiloxane, and functionalized polydimethylsiloxane such as those available under the name Abil B9952; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. Nos. 3,048,548 and 3,334,147, the disclosures of which are incorporated herein by reference.

As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

As used herein, the term "phosphorus-free" or "substantially phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt. %. Preferably, the amount of phosphorus is less than 0.1 wt. %, more preferably the amount of phosphorus is less than 0.01 wt. %, and most preferably the amount of phosphorous is about 0.00 wt. %.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the detergent compositions described herein include but are not limited to, those that include polycarbonate polymers (PC), acrylonitrile-butadiene-styrene polymers (ABS), and polysulfone polymers (PS). Another exemplary plastic that can be cleaned using the detergent compositions include polyethylene terephthalate (PET).

The term "weight percent," "wt. %," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt. %," etc.

The methods and detergent compositions described herein may comprise, consist essentially of, or consist of the components and ingredients enumerated in exemplary embodiments as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Compositions

According to an embodiment, the detergent compositions incorporate a maleic acid-based tetrapolymer, together with one or more sources of alkalinity, a water conditioning agent, corrosion inhibitor, nonionic surfactant, polycarboxylic acid, and additional ingredients to provide significantly improved inhibition of calcium carbonate deposition on glass and plastic surfaces.

Further description of suitable formulations is shown in the Tables below:

TABLE 1A

| Formulations | Example Range 1 (wt. %) | Example Range 2 (wt. %) | Example Range 3 (wt. %) |
|---|---|---|---|
| Maleic Acid-Based Tetrapolymer | 0.0001-30 | 0.001-20 | 1-15 |
| Alkalinity Source(s) | 1-90 | 5-80 | 10-20 |
| Water Conditioning Agents/Chelants/Builders | 1-95 | 1-75 | 1-55 |
| Corrosion Inhibitor | 0.001-30 | 0.01-20 | 0.5-10 |
| One or More Surfactants | 1-90 | 5-75 | 5-50 |
| Additional Functional Ingredients | 0-90 | 1-50 | 2-25 |

TABLE 1B

| Formulations | Example Range 1 (wt. %) | Example Range 2 (wt. %) | Example Range 3 (wt. %) |
|---|---|---|---|
| Maleic Acid-Based Tetrapolymer | 0.0001-30 | 0.001-20 | 1-15 |
| First Alkalinity Source | 1-90 | 5-80 | 10-20 |
| Second Alkalinity Source | 0-90 | 20-70 | 55-65 |
| Water Conditioning Agents/Chelants/Builders | 0-40 | 0.5-25 | 5-15 |
| Corrosion Inhibitor | 0-10 | 0.001-5 | 0.05-0.5 |
| Nonionic Surfactant | 0-10 | 0.001-5 | 0.1-5 |
| Polycarboxylic Acid | 0-40 | 1-25 | 5-20 |
| Carrier | 0-50 | 0.01-20 | 0.1-10 |
| Filler | 0-40 | 0.5-20 | 1-10 |
| Additional Functional Ingredients | 0-90 | 1-50 | 2-25 |
| Water | 0-90 | 0-60 | 0-1 |

Maleic Acid-Based Tetrapolymer

According to an embodiment, the detergent compositions include a malic acid based tetrapolymer. Polymaleic acid can be an effective calcium carbonate scale inhibitor. In particular, polymaleic acid-based tetrapolymers can provide excellent scale inhibition. In an aspect, the detergent compositions include a polymaleic acid copolymer, wherein the copolymer contains monocarboxylic acids, terminal hydroxyl groups, and nonionic functional groups.

The polymer may include a quantity of non-functionalized groups which may, in application, aid in the adsorption of the polymer onto a crystal surface. The polymer may preferably include mono-carboxylic acids, non-ionic functional groups, and terminal hydroxyl groups in proportions to achieve the desired treatment functionalities. For example, such a copolymer may include at least approximately 10% (Mw) polymaleic acid and at least approximately 10% (Mw) of in-situ formed co-monomers, including at least 10% (Mw) decarboxylated maleic acid. In some instances, the polymer may have a significantly higher proportion of decarboxylated monomeric repeating units in the enhanced copolymer. In some instances, the molecular weight of the combined copolymer is between about 300 and about 3,000 Daltons In a preferred embodiment, the polymer may contain, on a molar basis, mono-carboxylic acids, terminal hydroxyl groups, and nonionic functional groups such that the polymer comprises at least 50% maleic acid and up to about 50% of free radical polymerized comonomers. In an embodiment, the maleic acid comprises at least 5% decarboxylated maleic acid repeating units. In a further embodiment, the nonionic functional groups and terminal hydroxyl groups are formed during an aqueous polymerization process.

In a still further embodiment, the polymer may contain, on a molar basis, over 50% maleic acid, up to about 5% of maleic anhydride, up to about 50% of acrylic acid, and up to about 50% of a 2-carbon alkane group.

A polymer prepared in accordance with the principles disclosed herein, or characterized by the attributes disclosed herein, may beneficially be applied to a system (e.g. an aqueous system) as a treatment additive to prevent or remediate mineral scaling. In application, the polymer may, among other functionalities, adsorb onto crystalloid or crystal lattice structures, with a result of modifying the crystal habit of, e.g., an undesirable inorganic compound.

Further discussion of appropriate tetrapolymers, and methods of making thereof, is found in US 2018/0215638 and US 2016/0115051, which are herein incorporated by reference in their entirety.

In a preferred embodiment, the maleic acid-based tetrapolymer is Initie 585, commercially available from Radical Polymers.

In an embodiment, the maleic acid-based tetrapolymer is present in an amount of greater than about 1 wt. %. In some embodiments, the detergent compositions include the maleic acid-based tetrapolymer in an amount of between about 0.0001 wt. % to about 30 wt. %, preferably between about 0.001 wt. % to about 20 wt. %, more preferably between about 1 wt. % to about 15 wt. %.

Alkalinity Source

According to an embodiment, the detergent compositions include one or more alkalinity sources. Exemplary alkalinity sources include alkali metal carbonates and/or alkali metal hydroxides. In a preferred embodiment, the compositions include two sources of alkalinity. In a further embodiment, the two sources of alkalinity include sodium hydroxide (50%) and a caustic bead.

Alkali metal carbonates used in the formulation of detergents are often referred to as ash-based detergents and most often employ sodium carbonate. Additional alkali metal carbonates include, for example, sodium or potassium carbonate. In an aspect, the alkali metal carbonates are further understood to include metasilicates, silicates, bicarbonates and sesquicarbonates. As described herein, any "ash-based" or "alkali metal carbonate" shall also be understood to include all alkali metal carbonates, metasilicates, silicates, bicarbonates and/or sesquicarbonates.

Alkali metal hydroxides used in the formulation of detergents are often referred to as caustic detergents. Examples of suitable alkali metal hydroxides include sodium hydroxide, potassium hydroxide, and lithium hydroxide. Exemplary alkali metal salts include sodium carbonate, potassium carbonate, and mixtures thereof. The alkali metal hydroxides may be added to the composition in any form known in the art, including as solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 45% and a 50% by weight solution.

In addition to the first alkalinity source, the detergent composition may comprise a secondary alkalinity source. Examples of useful secondary alkaline sources include but are not limited to metal silicates such as sodium or potassium silicate or metasilicate; metal carbonates such as sodium or potassium carbonate, bicarbonate, sesquicarbonate; metal borates such as sodium or potassium borate; and ethanolamines and amines. Such alkalinity agents are commonly available in either aqueous or powdered form, either of which is useful in formulating the present detergent compositions.

An effective amount of one or more alkalinity sources is provided in the detergent composition. An effective amount is referred to herein as an amount that provides a use composition having a pH of between about 8 to about 13, more preferably, between about 9 to about 12.

In some embodiments, the compositions include between about 1 wt. % to about 90 wt. % of a first alkalinity source, preferably between about 5 wt. % to about 40 wt. %, more preferably between about 10 wt. % to about 20 wt. % of the first alkalinity source. In an embodiment, the compositions include a second alkalinity source, present in an amount of between about 0 wt. % to about 90 wt. %, preferably between about 20 wt. % to about 70 wt. %, more preferably between about 55 wt. % to about 65 wt. %.

Surfactants

In some embodiments, the detergent compositions described herein include one or more surfactants. Surfactants suitable for use include, but are not limited to, nonionic surfactants, anionic surfactants, cationic surfactants, amphoteric surfactants and/or zwitterionic surfactants.

In some embodiments, the detergent compositions include between about 0 wt. % to about 90 wt. % of one or more surfactants, including, for example, about 10 wt. %, 20 wt. %, 30 wt. %, 40 wt. %, 50 wt. %, 60 wt. %, 70 wt. %, 80 wt. % of one or more nonionic, anionic, cationic, amphoteric, and/or zwitterionic surfactants. In an embodiment, the detergent compositions include one or more nonionic surfactants present in amounts of between about 0 wt. % to about 10 wt. %, preferably between about 0.001 wt. % to about 5 wt. %, more preferably between 0.1 wt. % to about 2 wt. %.

Nonionic Surfactants

Suitable nonionic surfactants suitable for use include, for example, alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic® and reverse Pluronic® surfactants; alcohol alkoxylates; capped alcohol alkoxylates; mixtures thereof, or the like.

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water-soluble compound having the desired degree of balance between hydrophilic and hydrophobic properties.

Block polyoxypropylene-polyoxyethylene polymeric compounds based upon propylene glycol, ethylene glycol, glycerol, trimethylolpropane, and ethylenediamine as the initiator reactive hydrogen compound are suitable nonionic surfactants. Some examples of polyoxyethylene-polyoxypropylene block copolymers include those having the following formulae:

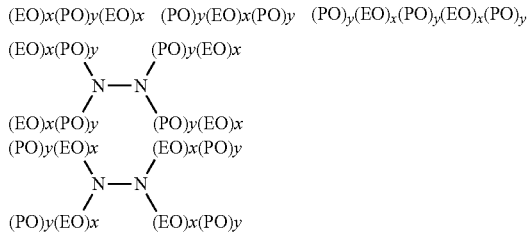

wherein EO represents an ethylene oxide group, PO represents a propylene oxide group, and x and y reflect the average molecular proportion of each alkylene oxide monomer in the overall block copolymer composition. In some embodiments, x is in the range of about 10 to about 130, y is in the range of about 15 to about 70, and x plus y is in the range of about 25 to about 200. It should be understood that each x and y in a molecule can be different. In some embodiments, the total polyoxyethylene component of the block copolymer can be in the range of at least about 20 mol-% of the block copolymer and in some embodiments, in the range of at least about 30 mol-% of the block copolymer. In some embodiments, the material can have a molecular weight greater than about 400, and in some embodiments, greater than about 500. For example, in some embodiments, the material can have a molecular weight in the range of about 500 to about 7000 or more, or in the range of about 950 to about 4000 or more, or in the range of about 1000 to about 3100 or more, or in the range of about 2100 to about 6700 or more.

Although the exemplary polyoxyethylene-polyoxypropylene block copolymer structures provided above have 3-8 blocks, it should be appreciated that the nonionic block copolymer surfactants can include more or less than 3 or 8 blocks. In addition, the nonionic block copolymer surfactants can include additional repeating units such as butylene oxide repeating units. Furthermore, suitable nonionic block copolymer surfactants can be characterized as heteric polyoxyethylene-polyoxypropylene block copolymers. Examples of polymeric compounds made from a sequential propoxylation and ethoxylation of initiator are commercially available under the trade names Pluronic® and Tetronic® manufactured by BASF Corp, in particular Pluronic® N-3, Pluronic® 25-R2, and others.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Semi-Polar Nonionic Surfactants

The semi-polar type of nonionic surface-active agents are another class of nonionic surfactant which may be useful in the detergent compositions described herein. Semi-polar nonionic surfactants include the amine oxides, phosphine oxides, sulfoxides and their alkoxylated derivatives.

Amine oxides are tertiary amine oxides corresponding to the general formula:

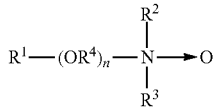

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkylene or a hydroxyalkylene group containing 2 to 3 carbon atoms; and n ranges from 0 to about 20. An amine oxide can be generated from the corresponding amine and an oxidizing agent, such as hydrogen peroxide.

Useful semi-polar nonionic surfactants also include the water-soluble phosphine oxides having the following structure:

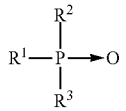

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl) dodecylphosphine oxide, and bis(hydroxymethyl)tetradecylphosphine oxide. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, iso-dodecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Semi-polar nonionic surfactants useful herein also include the water-soluble sulfoxide compounds which have the structure:

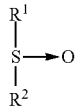

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms. Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Suitable semi-polar nonionic surfactants include, without limitation, dimethyl amine oxides, such as lauryl dimethyl amine oxide, myristyl dimethyl amine oxide, cetyl dimethyl amine oxide, combinations thereof, and the like. Alkoxylated amines or, most particularly, alcohol alkoxylated/aminated/alkoxylated surfactants are also suitable. These non-ionic surfactants may be at least in part represented by the general formulae: $R^{20}$—$(PO)_S$N-$(EO)_t$H, $R^{20}$—$(PO)_S$N-$(EO)_t$H$(EO)_t$H, and $R^{20}$—N$(EO)_t$H; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_C$—N[$(EO)_w$H][(EO) zH] in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants.

Anionic Surfactants

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages, and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

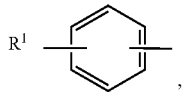

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

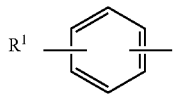

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate, or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphino. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Suitable long chain imidazole derivatives may generally have the general formula:

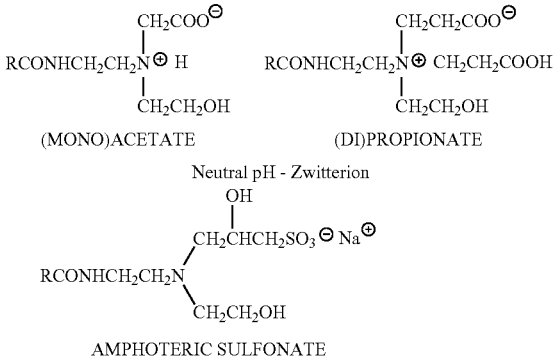

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes which are suitable include, without limitation, alkyl beta-amino dipropionates, $RN(C_2H_4COOM)_2$ and $RNHC2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+$($CH_2$—$CH_2$—$CO_2Na$)$_2$—$CH_2$—$CH_2$—OH or $C_{12}$-alkyl-C(O)—N(H)—$CH_2$—$CH_2$—$N^+$($CH_2$—$CO_2Na$)$_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J. A typical listing of amphoteric classes, and species of these surfactants are given in U.S. Pat. No. 3,929,678 and by J. Bertz Schwartz & J. W. Perry in Surface Active Agents and Detergents, Vol. I-II (1958), which are both herein incorporated by reference in their entirety.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure $R_nX+Y$ and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced, or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution. The simplest cationic amines, amine salts and quaternary ammonium compounds can be schematically drawn thus:

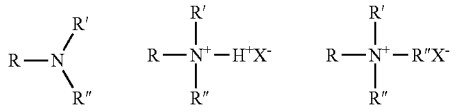

in which, R represents a long alkyl chain, R', R", and R'" may be either long alkyl chains or smaller alkyl or aryl groups or hydrogen and X represents an anion. The majority of large volume commercial cationic surfactants can be subdivided into four major classes and additional sub-groups known to those or skill in the art and described in "*Surfactant Encyclopedia*," Cosmetics & Toiletries, 104(2), 86-96 (1989), which is herein incorporated by reference in its entirety. The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like. Suitable cationic surfactants include, without limitation, those having the formula $R^1mR^2xYLZ$ wherein each $R^1$ is an organic group containing a straight or branched alkyl or alkenyl group optionally substituted with up to three phenyl or hydroxy groups and optionally interrupted by up to four of the following structures:

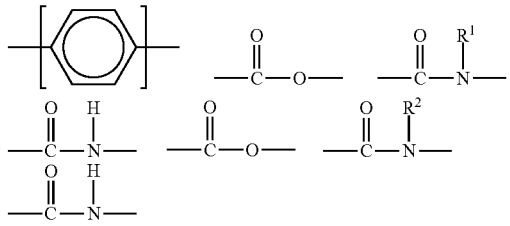

or an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl. x is a number from 0 to 11, preferably from 0 to 6. The remainder of any carbon atom positions on the Y group are filled by hydrogens. Y is can be a group including, but not limited to:

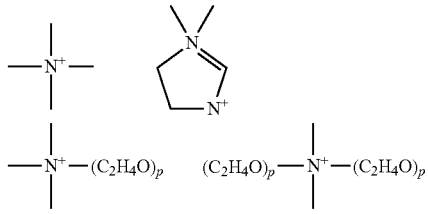

-continued p = about 1 to 12

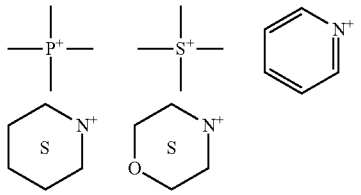

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water-soluble anion, such as a halide, sulfate, methylsulfate, hydroxide, or nitrate anion, particularly preferred being chloride, bromide, iodide, sulfate, or methyl sulfate anions, in a number to give electrical neutrality of the cationic component.

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong" inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

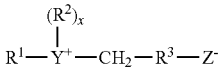

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxy ethyl)-N(2-hydroxydodecyl)ammonio]-butane-1-carboxylate; 3-[ S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

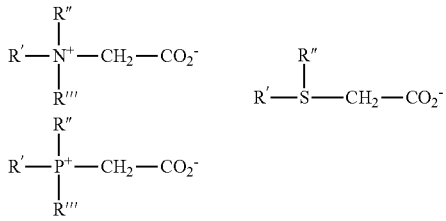

These surfactant betaines typically do not exhibit strong cationic or anionic characters at pH extremes, nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12}$-14 acylamidopropylbetaine; $C_8$-14 acylamidohexyldiethyl betaine; 4-$C_{14}$-16 acylmethylamidodiethylammonio-1-carboxybutane; $C_{16}$-18 acylamidodimethylbetaine; $C_{12}$-16 acylamidopentanediethylbetaine; and $C_{12}$-16 acylmethylamidodimethylbetaine.

Suitable sultaines may include, without limitation, those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 and by J. Bertz Schwartz & J. W. Perry in Surface Active Agents and Detergents, Vol. I-II (1958).

Phosphinosuccinic Acid (PSO) Derivatives

The detergent compositions may employ a phosphinosuccinic acid (PSO) derivative. PSO derivatives may also be described as phosphonic acid-based compositions. In an aspect, PSO derivatives may be a combination of mono-, bis- and oligomeric phosphinosuccinic acid adducts and a phosphinosuccinic acid (PSA) adduct.

The phosphinosuccinic acid (PSA) adducts may have the formula (I) below:

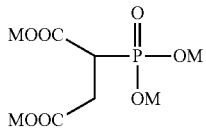

The mono-phosphinosuccinic acid adducts have the formula (II) below:

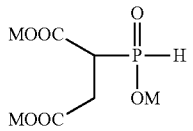

The bis-phosphinosuccinic acid adducts have the formula (III) below:

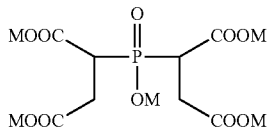

An exemplary structure for the oligomeric phosphinosuccinic acid adducts is shown in formula (IV) below:

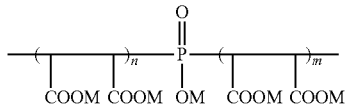

where M is $H^+$, $Na^+$, $K^+$, $NH4^+$, or mixtures thereof; and the sum of m plus n is greater than 2.

Additional oligomeric phosphinosuccinic acid adduct structures are set forth for example in U.S. Pat. Nos. 5,085,794, 5,023,000 and 5,018,577, each of which are incorporated herein by reference in their entirety. The oligomeric species may also contain esters of phosphinosuccinic acid, where the phosphonate group is esterified with a succinate-derived alkyl group. Furthermore, the oligomeric phosphinosuccinic acid adduct may comprise between about 1 wt. % to about 20 wt. % of additional monomers selected, including, but not limited to acrylic acid, methacrylic acid, itaconic acid, 2-acylamido-2-methylpropane sulfonic acid (AMPS), and acrylamide.

The adducts of formula I, II, III and IV may be used in the acid or salt form. Further, in addition to the phosphinosuccinic acids and oligomeric species, the composition may also contain some phosphinosuccinic acid derivative (I) from the oxidation of adduct II, as well as impurities such as various inorganic phosphorous byproducts of formula $H_2P0_2$-, $HP0_3^{2-}$ and $PO_4^{3-}$.

In an aspect, the mono-, bis- and oligomeric phosphinosuccinic acid adducts and the phosphinosuccinic acid (PSA) may be provided in the following mole and weight ratios.

| Species: | Mono | PSA | Bis | Oligomer |
|---|---|---|---|---|
| Formula | $C_4H_7PO_6$ | $C_4H_7PO_7$ | $C_8H_{11}PO_{10}$ | $C_{14.1}H_{17.1}PO_{16.1}$ |
| MW | 182 | 198 | 298 | 475.5 (avg.) |
| Mole Fraction (by NMR) | 0.238 | 0.027 | 0.422 | 0.309 |
| Wt. Fraction (as acid) | 0.135 | 0.017 | 0.391 | 0.457 |

Detergent compositions and methods of use may employ the phosphinosuccinic acid derivative and may include one or more of PSO derivatives selected from mono-, bis- and oligomeric phosphinosuccinic acid and a phosphinosuccinic acid, wherein at least about 10 mol % of the derivative comprises a succinic acid:phosphorus ratio of about 1:1 to about 20:1. The phosphinosuccinic acid derivative may include one or more of the PSO derivatives selected from mono-, bis- and oligomeric phosphinosuccinic acid and optionally a phosphinosuccinic acid wherein at least about 10 mol % of the derivative comprises a succinic acid: phosphorus ratio of about 1:1 to about 15:1. More particularly, the phosphinosuccinic acid derivative may include one or more derivatives selected from mono-, bis- and oligomeric phosphinosuccinic acid and optionally a phosphinosuccinic acid wherein at least about 10 mol % of the derivative comprises a succinic acid:phosphorus ratio of about 1:1 to about 10:1.

Additional description of suitable mono-, bis- and oligomeric phosphinosuccinic acid adducts comprising suitable PSO derivatives is provided in U.S. Pat. No. 6,572,789 which is incorporated herein by reference in its entirety.

In aspects of the invention the detergent composition is nitrilotriacetic acid (NTA)-free to meet certain regulations. In additional aspects of the invention the detergent composition is substantially phosphorous free to meet certain regulations. The PSO derivatives may provide substantially phosphorous free detergent compositions having less than about 0.5 wt. % of phosphorus. More preferably, the amount of phosphorus is a detergent composition may be less than about 0.1 wt. %. Accordingly, it is a benefit of the detergent compositions described herein to provide detergent compositions capable of controlling (i.e. preventing) hardness scale accumulation on a substrate surface without the use of phosphates, such as tripolyphosphates, commonly used in detergents to prevent hardness scale and/or accumulation.

When utilized in the detergent compositions described herein, PSO derivatives may be present in amounts of between about 0 wt. % to about 15 wt. %, preferably between about 1 wt. % to about 10 wt. %, more preferably between about 5 wt. % to about 10 wt. %.

Water Conditioning Agents, Builders, Chelants, and/or Sequestrants

The composition can include one or more water conditioning agents or building agents, also called chelating or sequestering agents (e.g., builders), including, but not limited to: condensed phosphates, alkali metal carbonates, phosphonates, aminocarboxylic acids, polycarboxylic acids, polycarboxylic acid polymers, and/or polyacrylates. In general, a chelating agent is a molecule capable of coordinating (i.e., binding) the metal ions commonly found in natural water to prevent the metal ions from interfering with the action of the other detersive ingredients of a cleaning composition. Similarly, builders and water conditioning agents also aid in removing metal compounds. Exemplary water conditioning agents include anti-redeposition agents, chelating agents, sequestering agents, and inhibitors.

Examples of condensed phosphates include but are not limited to sodium and potassium orthophosphate, sodium and potassium pyrophosphate, sodium tripolyphosphate, and sodium hexametaphosphate. A condensed phosphate may also assist, to a limited extent, in solidification of the composition by fixing the free water present in the composition as water of hydration.

Examples of phosphonates include, but are not limited to: 2-phosphinobutane-1,2,4-tricarboxylic acid (PBTC), 1-hydroxyethane-1, 1-diphosphonic acid, $CH_2C(OH)[PO(OH)_2]_2$; aminotri(methylenephosphonic acid), $N[CH_2 PO(OH)_2]_3$; aminotri(methylenephosphonate), sodium salt (ATMP), $N[CH_2 PO(ONa)_2]_3$; 2-hydroxyethyliminobis (methylenephosphonic acid), $HOCH_2CH_2N[CH_2PO(OH)_2]_2$; diethylenetriaminepenta(methylenephosphonic acid), $(HO)_2POCH_2N[CH_2N[CH_2PO(OH)_2]_2]_2$; diethylenetriaminepenta(methylenephosphonate), sodium salt (DTPMP), $C_9H_{(28-x)}N_3Na_xO_{15}P_5$ (x=7); hexamethylenediamine(tetramethylenephosphonate), potassium salt, $C_{10}H_{(28-x)}N_2K_xO_{12}P_4$ (x=6); bis(hexamethylene)triamine (pentamethylenephosphonic acid), $(HO_2)POCH_2N[(CH_2)_2N[CH_2PO(OH)_2]_2]_2$; and phosphorus acid, $H_3PO_3$. Preferred phosphonates are PBTC, HEDP, ATMP and DTPMP. A neutralized or alkali phosphonate, or a combination of the phosphonate with an alkali source prior to being added into the mixture such that there is little or no heat or gas generated by a neutralization reaction when the phosphonate is added is preferred. In one embodiment, however, the composition is phosphorous-free.

Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), methylglycinediacetic acid (MGDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2-2'-iminodisuccinic acid (HIDS) and other similar acids or salts thereof having an amino group with a carboxylic acid substituent. In one embodiment, however, the composition is free of aminocarboxylates.

Suitable organic water conditioning agents can include both polymeric and small molecule water conditioning agents. Organic small molecule water conditioning agents are typically organocarboxylate compounds or organophosphate water conditioning agents. Polymeric inhibitors commonly comprise polyanionic compositions such as polyacrylic acid compounds. More recently the use of sodium carboxymethyl cellulose as an antiredeposition agent was discovered. This is discussed more extensively in U.S. Pat. No. 8,729,006 to Miralles et al., which is incorporated herein in its entirety.

Small molecule organic water conditioning agents include, but are not limited to: sodium gluconate, sodium glucoheptonate, N-hydroxyethylenediaminetriacetic acid (HEDTA), ethylenediaminetetraacetic acid (EDTA), nitrilotriacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N—N-diacetic acid trisodium salt (MGDA), and iminodisuccinate sodium salt (IDS). All of these are known and commercially available.

Suitable inorganic water conditioning agents include, but are not limited to, sodium tripolyphosphate and other higher linear and cyclic polyphosphates species. Suitable condensed phosphates include sodium and potassium orthophosphate, sodium and potassium pyrophosphate, sodium tripolyphosphate, and sodium hexametaphosphate. A condensed phosphate may also assist, to a limited extent, in solidification of the solid detergent composition by fixing the free water present in the composition as water of hydration.

In an embodiment, the composition can be substantially free of phosphorous, phosphates and/or phosphonates.

In addition to aminocarboxylates, which contain little or no NTA, water conditioning polymers can be used as non-phosphorous containing builders.

Polycarboxylic acid polymer chelants are non-phosphorus containing chelants. Polycarboxylates include those chelant polymers having pendant carboxylate (—CO2-) groups such as polyacrylic acid homopolymers, polymaleic acid homopolymers, maleic/olefin copolymers, sulfonated copolymers or terpolymers, acrylic/maleic copolymers or terpolymers polymethacrylic acid homopolymers, polymethacrylic acid copolymers or terpolymers, acrylic acid-methacrylic acid copolymers, hydrolyzed polyacrylamides, hydrolyzed polymethacrylamides, hydrolyzed polyamide-methacrylamide copolymers, hydrolyzed polyacrylonitriles, hydrolyzed polymethacrylonitriles, hydrolyzed acrylonitrile-methacrylonitrile copolymers and combinations thereof. For a further discussion of chelating agents/sequestrants, see Kirik-Othmer Encyclopedia of Chemical Technology (3 Ed.), vol. 5 pp. 339-66, vol. 23, pp. 319-20, the disclosure of which is incorporated by reference herein. These materials may also be used at sub-stoichiometric levels to function as crystal modifiers.

Polycarboxylic acid polymer chelants can include polyacrylic acid homopolymers and polymaleic acid homopolymers, and polymers modified by a fatty acid end group. Exemplary polyacrylic acid homopolymers include those with a molecular weight between about 500-100,000 g/mol, or between about 1,000-50,000 g/mol, or between about 1,000-25,000 g/mol. Exemplary suitable commercially available polyacrylic acid polymers include Acusol 445N (a fully neutralized homopolymer of acrylic acid), Acusol 448 and Acusol 944 available from Dow Chemical. Exemplary suitable commercially available polymaleic acid chelants/water conditioners include, for example, Belclene 200, commercially available from BWA.

In additional embodiments, mixtures of acrylic acid homopolymers and/or polymers including acrylate monomers can be employed.

In an embodiment, the detergent compositions include one or more water conditioning agents, builders, chelants and/or sequestrants present in an amount of between about 0 wt. % and up to about 80 wt. %. In an embodiment, the detergent composition includes a small molecule organic water conditioning agent and polycarboxylic acid polymer chelant, wherein the small molecule organic water condition agent is present in an amount of between about 0 wt. % to about 40 wt. %, preferably between about 0.5 wt. % to about 25 wt. %, more preferably between about 5 wt. % to about 15 wt. %; and wherein the polycarboxylic acid polymer chelant is present in an amount of between about 0 wt. % to about 40 wt. %, preferably between about 1 wt. % to about 25 wt. %, more preferably between about 5 wt. % to about 15 wt. %.

Corrosion Inhibitor

The detergent compositions described herein may optionally include one or more corrosion inhibitors for addressing calcium carbonate-based scale or other types of mineral scale, including calcium sulfate, calcium phosphate, barium sulfate, strontium sulfate, iron hydroxide, silicone dioxide (silica), calcium oxalate, and others. Examples of suitable corrosion inhibitors include but are not limited to a combination of a source of aluminum ion and a source of zinc ion, as well as an alkaline metal silicate or hydrate thereof.

The corrosion inhibitor can refer to the combination of a source of aluminum ion and a source of zinc ion. The source of aluminum ion and the source of zinc ion provide aluminum ion and zinc ion, respectively, when the solid detergent composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof.

Exemplary sources of aluminum ion include but are not limited to: aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, and aluminum zinc sulfate. Exemplary sources of zinc ion include, but are not limited to: zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, and zinc salicylate.

In some embodiments, the detergent compositions contain one or more corrosion inhibitors present in an amount of between about 0 wt. % to about 10 wt. %, preferably between about 0.001 wt. % to about 5 wt. %, more preferably between about 0.05 wt. % to about 0.5 wt. %.

Defoaming Agent

The detergent compositions may include a defoaming agent. Defoaming agents maintain a low foam profile and/or cause dissolution of a foam profile under various water conditions, preferably under deionized or soft water conditions, and/or under mechanical action. In a still further aspect, the defoaming agents are compatible with surfactants, preferably nonionic surfactants, to achieve critical performance such as coupling/wetting, and improved material compatibility.

Any of a broad variety of suitable defoamers may be used, for example, any of a broad variety of nonionic ethylene oxide (EO) containing surfactants, in particular the nonionic surfactants described herein. Many nonionic ethylene oxide derivative surfactants are water soluble and have cloud points below the intended use temperature of the rinse aid composition, and therefore may be useful defoaming agents. Some examples of ethylene oxide derivative surfactants that may be used as defoamers include polyoxyethylene-polyoxypropylene block copolymers such as Pluronic® N-3, alcohol alkoxylates, low molecular weight EO containing surfactants, or the like, or derivatives thereof as described herein.

In an alternative aspect, the defoaming agent is a metal salt, including for example, aluminum, magnesium, calcium, zinc, and/or other rare earth metal salts. In a preferred aspect, the defoaming agent is a cation with high charge density, such as $Fe^{3+}$, $Al^{3+}$ and $La^{3+}$. In a preferred aspect, the defoaming agent is aluminum sulfate. In other aspects, the defoaming agent is not a transition metal compound. In some embodiments, the detergent compositions described herein can include antifoaming agents or defoamers which are of food grade quality, including for example silicone-based products.

In an aspect, the composition may include one or more defoaming agents present at any suitable concentration to provide a desired degree of defoaming. In some embodiments, the composition has a concentration of the defoaming agent from about 0.001 wt. % to about 10 wt. %, or from about 0.1 wt. % to about 5 wt. %. In still other embodiments, the defoaming agent has a concentration from about 0.1 wt. % to about 1 wt. %. In an embodiment, the composition includes two defoaming agents, in particular a metal salt such and a nonionic surfactant, wherein the metal salt is present in an amount of between about 0 wt. % to about 10 wt. %, preferably between about 0.001 wt. % to about 5 wt. %, more preferably between about 0.05 wt. % to about 0.5 wt. %; and wherein the nonionic surfactant is present in an amount of between about 0 wt. % to about 10 wt. %, preferably, between about 0.001 wt. % to about 5 wt. %, more preferably between about 0.1 wt. % to about 2 wt. %.

Carrier

The compositions comprise one or more carriers. Preferred carriers can include, but are not limited to, water and/or water-soluble carriers. Preferred water-soluble carriers include, but are not limited to, alcohols, water soluble diols, or mixtures thereof. Preferred alcohols include, but are not limited to, ethanol, n-propanol, and isopropanol. Preferred diols include, but are not limited to, pentylene glycol, hexylene glycol and propylene glycol. In an embodiment comprising water as a carrier, the water is deionized water or softened water.

In an embodiment, the detergent compositions include one or more carriers including a water soluble diol and deionized water, wherein the diol is present in an amount of between about 0 wt. % to about 50 wt. %, preferably between about 0.01 wt. % to about 8 wt. %, more preferably between about 0.1 wt. % to about 2 wt. %; and wherein the deionized water is present in an amount of between about 0 wt. % to about 90 wt. %, preferably between about 0 wt. % to about 50 wt. %, more preferably between about 0.5 wt. % to about 10 wt. %.

Fillers

In some embodiments, the detergent compositions can include a minor but effective amount of one or more fillers which is generally inert but may cooperate with the surfactant systems to enhance the overall capacity of the composition. Some examples of suitable fillers may include, without limitation, sodium sulfate, sodium chloride, starch, sugars, $C_1$-$C_{10}$ alkylene glycols such as propylene glycol, and combinations thereof.

In an aspect, the detergent compositions include between about 0 wt. % to about 40 wt. %, preferably between about 0.5 wt. % to about 10 wt. %, more preferably between about 1 wt. % to about 5 wt. % of one or more fillers.

Additional Functional Ingredients

The components of the detergent composition can be combined with various additional functional ingredients. In some embodiments, the detergent composition including the PSO derivatives and alkalinity source make up a large amount, or even substantially all of the total weight of the detergent composition, for example, in embodiments having few or no additional functional ingredients disposed therein. In these embodiments, the component concentrations ranges provided above for the detergent composition are representative of the ranges of those same components in the detergent composition.

The functional ingredients provide desired properties and functionalities to the detergent composition. For the purpose of this disclosure, the term "functional ingredients" includes an ingredient that when dispersed or dissolved in a use and/or concentrate, such as an aqueous solution, provides a beneficial property in a particular use. Some examples of functional ingredients are discussed in more detail below, although the particular materials discussed are given by way of example only, and that a broad variety of other functional ingredients may be used. For example, many of the functional ingredients discussed below relate to materials used in cleaning applications. However, other embodiments may include functional ingredients for use in other applications.

Exemplary additional functional ingredients include for example: builders or water conditioners, including detergent builders; hardening agents; bleaching agents; fillers; defoaming agents; anti-redeposition agents; stabilizing agents; dispersants; enzymes; glass and metal corrosion inhibitors; fragrances and dyes; thickeners; etc. Further description of suitable additional functional ingredients is set forth in U.S. Pat. No. 8,748,364, which is incorporated herein by reference in its entirety.

In an embodiment, the compositions may contain one or more additional functional ingredients present in amounts of between about 0 wt. % to about 90 wt. %, between about 20 wt. % to about 50 wt. %, and/or between about 1 wt. % to about 10 wt. % of the composition.

Forms of the Compositions

The detergent compositions described herein may be formulated into solids, liquids, powders, pastes, gels, etc.

The detergent compositions may be provided as a liquid, including liquid concentrates. When provided as a concentrate, the compositions may be diluted to form use compositions. In general, a concentrate refers to a composition that is intended to be diluted with water to provide a use solution that contacts an object to provide the desired cleaning, rinsing, or the like. The detergent composition that contacts the articles to be washed can be referred to as a concentrate or a use composition (or use solution) dependent upon the formulation employed in methods as described herein.

A use solution may be prepared from the concentrate by diluting the concentrate with water at a dilution ratio that provides a use solution having desired detersive properties. The water that is used to dilute the concentrate to form the use composition can be referred to as water of dilution or a diluent and can vary from one location to another. The typical dilution factor is between approximately 1 and approximately 10,000 but will depend on factors including water hardness, the amount of soil to be removed and the like. In an embodiment, the concentrate is diluted at a ratio of between about 1:10 and about 1:10,000 concentrate to water. Particularly, the concentrate is diluted at a ratio of between about 1:100 and about 1:5,000 concentrate to water. More particularly, the concentrate is diluted at a ratio of between about 1:250 and about 1:2,000 concentrate to water. In a use solution, the detergent composition is present between about 10 ppm and about 10,000 ppm, preferably between about 200 ppm and about 5000 ppm, more preferably between about 500 ppm and about 2000 ppm, and between about 750 ppm and about 1500 ppm, and in a most preferred embodiment approximately 1000 ppm.

In other embodiments, the dilution ratio may be determined based on the desired concentration of one particular component, for example the maleic acid-based tetrapolymer. In an embodiment, the concentrate is diluted at a ratio resulting in low, but effective, levels of polymer, for example a use solution where the maleic acid-based tetrapolymer is present between about 1 ppm to about 100 ppm, preferably between about 1 ppm to about 40 ppm, more preferably between about 1 ppm and about 20 ppm, and most preferably between about 1 ppm and about 10 ppm.

In an embodiment, when provided as a liquid, the detergent compositions of the disclosure may, for example, be prepared according to Table 2 below:

TABLE 2

| Material | Wt. % Percent |
|---|---|
| NaOH (50%) | 40-60 |
| Builders | 0-5 |
| Other Polymers | 0-5 |
| Maleic Acid-Based Tetrapolymer | 0.1-10 |
| Water | 40-60 |

In addition to liquids, the detergents of the disclosure may be provided as solids. Solid detergent compositions provide certain commercial advantages. For example, use of concentrated solid detergent compositions decrease shipment costs as a result of the compact solid form, in comparison to bulkier liquid products. In certain embodiments, solid products may be provided in the form of a multiple-use solid, such as, a block or a plurality of pellets, and can be repeatedly used to generate aqueous use solutions of the detergent composition for multiple cycles or a predetermined number of dispensing cycles. In certain embodiments, the solid detergent compositions may have a mass greater than about 5 grams, such as for example from about 5 grams to 10 kilograms. In certain embodiments, a multiple-use form of the solid detergent composition has a mass of about 1 kilogram to about 10 kilogram or greater.

Suitable solid compositions produced according to the disclosure may take a variety of forms including but not limited to granular and pelletized solid compositions, flakes, powders, granules, pellets, tablets, lozenges, pucks, briquettes, bricks, unit doses, flowable solids, and/or block compositions, whether pressed, extruded, or cast.

In a pressed solid process, a flowable solid, such as granular solids or other particle solids are combined under pressure to form the solid composition. In a pressed solid process, flowable solids of the compositions are placed into a form (e.g., a mold or container). The method can include gently pressing the flowable solid in the form to produce the solid cleaning composition. Pressure may be applied by a block machine or a turntable press, or the like.

The detergent compositions may optionally be cured to produce the solid compositions. As referred to herein, an uncured composition including the flowable solid is compressed to provide sufficient surface contact between particles making up the flowable solid that the uncured composition will solidify into a stable solid composition. A sufficient quantity of particles (e.g. granules) in contact with one another provides binding of particles to one another effective for making a stable solid composition. Inclusion of a curing step may include allowing the pressed solid to solidify for a period of time, such as a few hours, or about 1 day (or longer). In additional aspects, the methods could include vibrating the flowable solid in the form or mold, such as the methods disclosed in U.S. Pat. No. 8,889,048, which is herein incorporated by reference in its entirety.

The use of pressed solids provides numerous benefits over conventional solid block or tablet compositions requiring high pressure in a tablet press, or casting requiring the melting of a composition consuming significant amounts of energy, and/or by extrusion requiring expensive equipment and advanced technical know-how. Pressed solids overcome such various limitations of other solid formulations for which there is a need for making solid compositions. Moreover, pressed solid compositions retain its shape under conditions in which the composition may be stored or handled.

In an embodiment, the detergent compositions of the disclosure may be provided in the form of pellets. In an aspect, pelletized materials can be formed by compressing the solid granular or agglomerated complex of urea and acid in appropriate pelletizing equipment to result in appropriately sized pelletized materials. Solid block and cast solid block materials can be made by introducing into a container either a pre-hardened block or a solid block that hardens within a container. Preferred containers include disposable plastic containers or water-soluble film containers. Other suitable packaging for the composition includes flexible bags, packets, shrink wrap, and water-soluble film such as polyvinyl alcohol.

In other aspects, the solid compositions may be formed using a batch or continuous mixing system to combine the materials described herein. In an exemplary embodiment, a single- or twin-screw extruder is used to combine and mix one or more components at high shear to form a homogeneous mixture. In some embodiments, the processing temperature is at or below the melting temperature of the components. The processed mixture may be dispensed from the mixer by forming, casting or other suitable means, whereupon the cleaning composition hardens to a solid form. Generally, a solid composition processed according to these methods is substantially homogeneous with regard to the distribution of ingredients throughout its mass and is dimensionally stable.

In an extrusion process, the components of the composition are introduced into final mixing system and are continuously mixed until the components form a substantially homogeneous semi-solid mixture in which the components are distributed throughout its mass. The mixture is then discharged from the mixing system into, or through, a die or other shaping means. The product is then packaged. In an exemplary embodiment, the formed composition begins to harden to a solid form.

In a casting process, the components of the composition are introduced into the final mixing system and are continuously mixed until the components form a substantially homogeneous liquid mixture in which the components are distributed throughout its mass. Once the mixing is complete, the product is transferred to a packaging container where solidification takes place. In an exemplary embodiment, the cast composition begins to harden to a solid form.

In an embodiment, when provided as a solid, the detergent compositions of the disclosure may, for example, be prepared according to Table 3 below:

TABLE 3

| Material | Wt. % Percent |
|---|---|
| NaOH (50%) | 10-60 |
| Builders | 0-20 |
| Other Polymers | 0-15 |
| Water | 0-10 |
| NaOH Bead | 35-65 |
| Sodium sulfate | 0-10 |
| Maleic Acid-Based Tetrapolymer | 0.1-15 |
| Ethylene Oxide/Propylene Oxide (EO/PO) Block Copolymer | 0.1-5 |

Methods of Use

The detergent compositions described herein are suitable for use in various applications and methods, including any application suitable for an alkali metal hydroxide and/or alkali metal carbonate detergent. More particularly, the detergent compositions described herein may be used in any industry where use of an alkaline detergent is desired and where it is beneficial to prevent the formation of, or remove calcium carbonate scale accumulation on glass, plastic, and/or metal surfaces. In addition, the compositions and methods are well suited for controlling water hardness buildup on a plurality of surfaces. The methods described herein prevent moderate to heavy accumulation hardness on treated substrate surfaces beneficially improving the aesthetic appearance of the surface. In certain embodiments, surfaces in need of hard water scale accumulation prevention, include for example, plastics, metal, glass surfaces, and/or any suitable hard surface.

Methods of use employing the detergent compositions described herein are particularly suitable for institutional ware washing. Exemplary disclosure of warewashing applications is set forth in U.S. Pat. Nos. 8,758,520 and 9,139,800, including all references cited therein, which are herein incorporated by reference in its entirety. The method may be carried out in any consumer or institutional dish machine, including for example those described in U.S. Pat. No. 8,092,613, which is incorporated herein by reference in its entirety, including all figures and drawings. Some non-limiting examples of dish machines include door machines or hood machines, conveyor machines, undercounter machines, glasswashers, flight machines, pot and pan machines, utensil washers, and consumer dish machines. The dish machines may be either single tank or multi-tank machines.

A door dish machine, also called a hood dish machine, refers to a commercial dish machine wherein the soiled dishes are placed on a rack and the rack is then moved into the dish machine. Door dish machines clean one or two racks at a time. In such machines, the rack is stationary, and the wash and rinse arms move. A door machine includes two sets arms, a set of wash arms and a rinse arm, or a set of rinse arms.

Door machines may be a high temperature or low temperature machine. In a high temperature machine, the dishes are sanitized by hot water. In a low temperature machine, the dishes are sanitized by the chemical sanitizer. The door machine may either be a recirculation machine or a dump and fill machine. In a recirculation machine, the detergent solution is reused, or "recirculated" between wash cycles. The concentration of the detergent solution is adjusted between wash cycles so that an adequate concentration is maintained. In a dump and fill machine, the wash solution is not reused between wash cycles. New detergent solution is added before the next wash cycle. Some non-limiting examples of door machines include the Ecolab Omega HT, the Hobart AM-14, the Ecolab ES-2000, the Hobart LT-1, the CMA EVA-200, American Dish Service L-3DW and HT-25, the Autochlor A5, the Champion D-HB, and the Jackson Tempstar.

The detergent compositions are effective at preventing hard water scale accumulation in warewashing applications using a variety of water sources, including hard water. In addition, the detergent compositions are suitable for use at temperature ranges typically used in industrial warewashing applications, including for example from about 150° F. to about 165° F. during washing steps and from about 170° F. to about 185° F. during rinsing steps.

In addition, the methods of use of the detergent compositions are also suitable for CIP and/or COP processes to replace the use of bulk detergents leaving hard water residues on treated surfaces. The methods of use may be desirable in additional applications where industrial standards are focused on the quality of the treated surface, such that the prevention of hard water scale accumulation provided by the detergent compositions. Such include, but are not limited to, vehicle care, industrial, hospital and textile care.

Additional industries in which the detergent compositions may be of use include food and beverage applications, the restaurant/dining industry, textile care/laundry, the healthcare industry (e.g. hospitals, care facilities, clinics, etc.) and/or pest elimination. Examples of applications of use for the detergent compositions include, for example, alkaline detergents effective as grill and oven cleaners, ware wash detergents, laundry detergents, laundry presoaks, drain cleaners, hard surface cleaners, surgical instrument cleaners, transportation vehicle cleaning, vehicle cleaners, dish wash presoaks, dish wash detergents, beverage machine cleaners, concrete cleaners, building exterior cleaners, metal cleaners, floor cleaners, counter cleaners, table cleaners, degreasers, burned-on soil removers, textiles, and/or fabrics. In a variety of these applications, cleaning compositions having a high alkalinity are most desirable and efficacious, however the damage caused by hard water scale accumulation is undesirable.

The various methods of use as described herein employ the use of the detergent composition, which may be formed prior to or at the point of use by combining the components of the detergent composition in the weight percentages disclosed herein. The detergent composition may be provided in various formulations. The methods of use may employ any of the formulations disclosed, including for example, liquids, semi-solids, and/or other solid formulations as described herein.

The methods may also employ a concentrate and/or a use solution constituting an aqueous solution or dispersion of a concentrate as described herein. Such use solutions may be formed during the washing process such as during ware-washing processes.

In aspects, employing packaged solid detergent compositions, the products may first require removal from any applicable packaging (e.g. film). Thereafter, according to certain methods of use, the compositions can be inserted directly into a dispensing apparatus and/or provided to a water source for cleaning. Examples of such dispensing systems include for example U.S. Pat. Nos. 4,826,661, 4,690,305, 4,687,121, 4,426,362 and U.S. Pat. Nos. Re. 32,763 and Re. 32,818, the disclosures of which are incorporated by reference herein in its entirety. Ideally, a solid detergent composition is configured or produced to closely fit the particular shape(s) of a dispensing system in order to prevent the introduction and dispensing of an incorrect solid product into the apparatus.

In certain embodiments, the detergent composition may be mixed with a water source prior to or at the point of use. In other embodiments, the detergent compositions do not require the formation of a use solution and/or further dilution and may be used without further dilution.

In aspects, employing solid detergent compositions, a water source contacts the detergent composition to convert solid detergent compositions, particularly powders, into use solutions. Additional dispensing systems may also be utilized which are more suited for converting alternative solid detergents compositions into use solutions. The methods include use of a variety of solid detergent compositions, including, for example, extruded blocks or "capsule" types of package.

In an aspect, a dispenser may be employed to spray water (e.g. in a spray pattern from a nozzle) to form a detergent use solution. For example, water may be sprayed toward an apparatus or other holding reservoir with the detergent composition, wherein the water reacts with the solid detergent composition to form the use solution. In certain embodiments of the methods, a use solution may be configured to drip downwardly due to gravity until the dissolved solution of the detergent composition is dispensed for use. In an aspect, the use solution may be dispensed into a wash solution of a ware wash machine.

All publications and patent applications in this specification are indicative of the level of ordinary skill in the art to which this disclosure pertains. All publications and patent applications are herein incorporated by reference to the same extent as if each individual publication or patent application were specifically and individually indicated as incorporated by reference.

EXAMPLES

Embodiments of the compositions described herein are further defined in the following non-limiting Examples. It should be understood that these Examples, while indicating certain embodiments, are given by way of illustration only. From the above discussion and these Examples, one skilled in the art can ascertain the essential characteristics of the compositions and methods described herein, and without departing from the spirit and scope thereof, can make various changes and modifications of the embodiments to adapt it to various usages and conditions. Thus, various modifications of the embodiments, in addition to those shown and described herein, will be apparent to those skilled in the art from the foregoing description. Such modifications are also intended to fall within the scope of the appended claims.

Example 1

To determine the ability of solid detergent compositions of the disclosure to remove spots and film from ware, solid detergent compositions were prepared according to Table 4 below. The detergents according to the present disclosure were compared to a Solid Detergent Control (containing high levels of alkalinity and no polymer), and also to Solid Detergent 6, a detergent comparable to commercially available detergents (containing other polymers used to minimize scaling).

TABLE 4

| Material | Solid Detergent Control (wt. %) | Solid Detergent 1 (wt. %) | Solid Detergent 2 (wt. %) | Solid Detergent 3 (wt. %) | Solid Detergent 4 (wt. %) | Solid Detergent 5 (wt. %) | Solid Detergent 6 (wt. %) | Solid Detergent 7 (wt. %) | Solid Detergent 8 (wt. %) | Solid Detergent 9 (wt. %) |
|---|---|---|---|---|---|---|---|---|---|---|
| NaOH (50%) | 60 | 14.2 | 14.2 | 14.2 | 14.2 | 14.2 | 40 | 14.2 | 14.2 | 0 |
| Builder | 0 | 7.9 | 7.9 | 7.9 | 7.9 | 7.9 | 0 | 7.9 | 7.9 | 80 |
| Other Polymers | 0 | 14.75 | 6.75 | 6.75 | 6.75 | 6.75 | 0 | 0 | 0 | 0 |
| Water | 3 | 0.5 | 0.5 | 2.5 | 3.5 | 4 | 1 | 5 | 7.1 | 0 |
| NaOH Bead | 35 | 58.6 | 58.6 | 58.6 | 58.6 | 58.6 | 45 | 58.6 | 58.6 | 13.6 |
| Sodium Sulfate | 0 | 3.2 | 3.2 | 5.2 | 7.2 | 6.7 | 0 | 5.4 | 7.4 | 0 |
| EO/PO Block Copolymer | 2 | 0.75 | 0.75 | 0.75 | 0.75 | 0.75 | 2 | 0.75 | 0.75 | 0 |
| Polymaleic Acid Homopolymer | 0 | 0 | 0 | 0 | 0 | 0 | 12 | 0 | 0 | 0 |
| Maleic Acid-Based Tetrapolymer | 0 | 0 | 8 | 4 | 2 | 1 | 0 | 8 | 4 | 6.4 |

After preparation of the formulations, six Libby 10 oz. glass tumblers were prepared by removing all film and foreign material from the surfaces of the glasses. An Apex HT warewash machine was then filled with an appropriate amount of water and the water was tested for hardness.

After recording the hardness value, the tank heaters were turned on. On the day of the experiments, the water hardness was 17 grains. The warewash machine was turned on and wash/rinse cycles were run through the machine until a wash temperature of between about 150° F. and about 160° F. and a rinse temperature of between about 175° F. and about 190° F. were reached. The controller was then set to dispense an appropriate amount of detergent into the wash tank. The detergent was dispensed such that when the detergent was mixed with water during the cycle to form a use solution, the detergent concentration in the use solution was 1000 parts per million (ppm). The solution in the wash tank was titrated to verify detergent concentration.

The six clean glass tumblers were placed diagonally in a Raburn rack and one Newport 10 oz. plastic tumbler was placed off-diagonally in the Raburn rack as shown in FIG. 17 (wherein P=plastic tumbler, G=glass tumbler), and the rack was placed inside the warewash machine.

The 100-cycle test was then started. At the beginning of each wash cycle, the appropriate amount of detergent was automatically dispensed into the warewash machine to maintain the initial detergent concentration. The detergent concentration was controlled by conductivity.

Upon completion of 100 cycles, the rack was removed from the warewash machine and the glass and plastic tumblers were allowed to dry. The glass and plastic tumblers were then graded for spot and film accumulation using an analytical light box evaluation.

The light box test used a digital camera, a light box, a light source, a light meter, and a control computer employing "Spot Advance" and "Image Pro Plus" commercial software. A glass to be evaluated was placed on its side on the light box, and the intensity of the light source was adjusted to a predetermined value using the light meter. A photographic image of the glass was taken and saved to the computer. The software was then used to analyze the upper half of the glass, and the computer displayed a histogram graph with the area under the graph being proportional to the thickness of the film.

Figure 16:
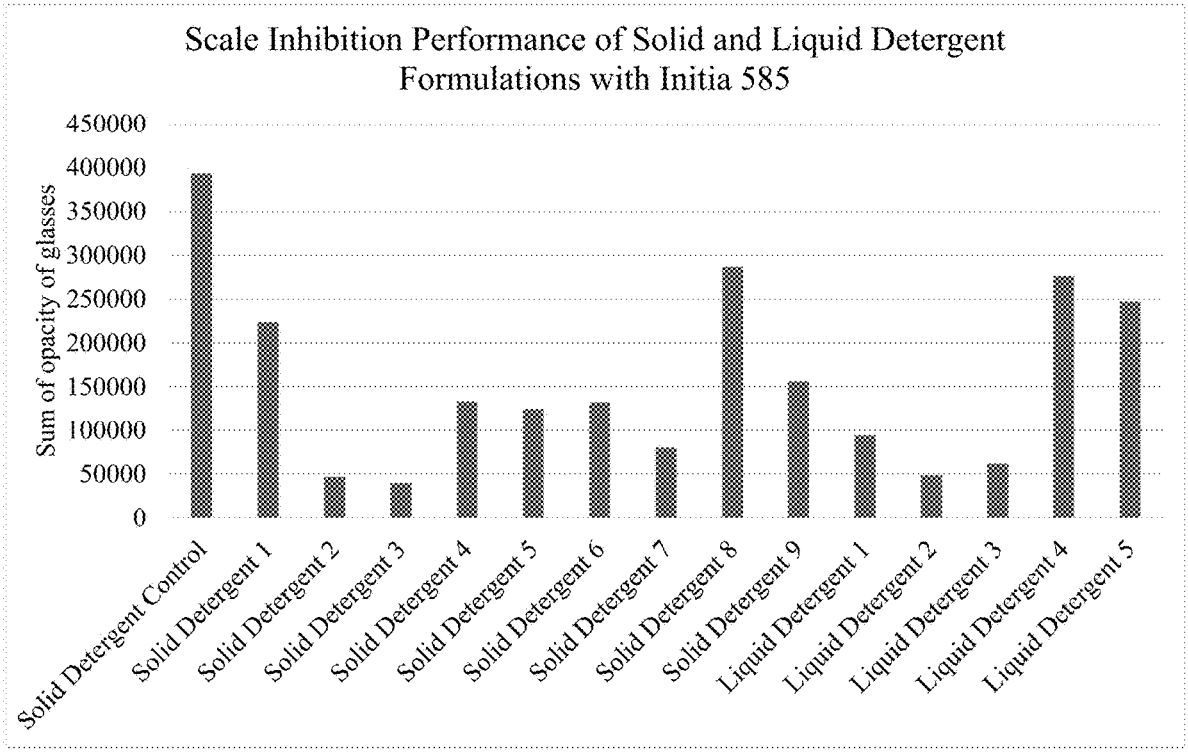
FIG. 16 is a graph comparing the lightbox scores of the solid and liquid detergent compositions evaluated in Examples 1-2.

Generally, a lower light box score indicates that more light was able to pass through the tumbler. Thus, the lower the light box score, the more effective the composition was at preventing scale on the surface of the tumbler. The results of the 100-cycle test and subsequent light box test are shown in Table 5 below and in FIG. 16.

TABLE 5

| Detergent | Dose (ppm) | Initia 585 Concentration (ppm) | Water Hardness (gpg) | Sum of Opacity of Glasses |
|---|---|---|---|---|
| Solid Detergent Control | 1000 | 0 | 17 | 393,210 |
| Solid Detergent 1 | 1000 | 0 | 17 | 223,723 |
| Solid Detergent 2 | 1000 | 40 | 17 | 46,974 |
| Solid Detergent 3 | 1000 | 20 | 17 | 39,862 |
| Solid Detergent 4 | 1000 | 10 | 17 | 133,323 |
| Solid Detergent 5 | 1000 | 5 | 17 | 124,442 |
| Solid Detergent 6 | 1000 | 0 | 17 | 132,289 |
| Solid Detergent 7 | 1000 | 40 | 17 | 80,375 |
| Solid Detergent 8 | 1000 | 20 | 17 | 286,734 |
| Solid Detergent 9 | 625 | 20 | 17 | 156,179 |

These results indicate the indicate the utility provided by the maleic acid-based tetrapolymer, as the compositions of the invention performed better than the composition containing no tetrapolymer or traditional calcium carbonate scale inhibitor. These data also show that the solid detergent compositions of the present disclosure performed significantly better than the control formulation in removing and preventing calcium carbonate accumulation on both plastic and glass. Further, the compositions of the present disclosure also performed at least as well as, and in many cases much better than, comparable commercially available formulations, and performed very well even in the absence of no additional water conditioning polymers. As shown by Solid Detergent 9, the compositions of the disclosure also provide substantially improved performance even at concentrations of about 500 ppm. These results are also visually illustrated in FIGS. 1-7 and 10.

Example 2

To determine the ability of liquid detergent compositions of the disclosure to remove spots and film from ware, liquid detergent compositions were prepared according to Table 6 below. The detergents according to the present disclosure were compared to a Control (containing high levels of alkalinity and no polymer), and also to Solid Detergent 6, a detergent comparable to commercially available detergents (containing other polymers used to minimize scaling).

TABLE 6

| Material | Solid Detergent Control (wt. %) | Liquid Detergent 1 (wt. %) | Liquid Detergent 2 (wt. %) | Liquid Detergent 3 (wt. %) | Liquid Detergent 4 (wt. %) | Liquid Detergent 5 (wt. %) | Solid Detergent 6 (wt. %) |
|---|---|---|---|---|---|---|---|
| NaOH (50%) | 60 | 47.6 | 47.6 | 47.6 | 47.6 | 47.6 | 40 |
| Builder | 0 | 2 | 2 | 0 | 0 | 0 | 0 |
| Other Polymers | 0 | 1.6 | 0 | 0 | 0 | 0 | 0 |
| Water | 3 | 48.8 | 48.8 | 44.4 | 48.4 | 51.4 | 1 |
| NaOH Bead | 35 | 0 | 0 | 0 | 0 | 0 | 45 |
| Sodium Sulfate | 0 | 0 | 0 | 0 | 0 | 0 | 0 |
| EO/PO Block Copolymer | 2 | 0 | 0 | 0 | 0 | 0 | 2 |
| Polymaleic Acid Homopolymer | 0 | 0 | 0 | 0 | 0 | 0 | 12 |
| Maleic Acid-Based Tetrapolymer | 0 | 0 | 1.6 | 8 | 4 | 1 | 0 |

After preparation of the formulations, the compositions of Table 4 were evaluated using the 100-cycle procedure outlined in Example 1. The results of the 100-cycle test and subsequent light box test are shown in Table 7 below and in FIG. 16.

TABLE 7

| Detergent | Dose (ppm) | Initia 585 Concentration (ppm) | Water Hardness (gpg) | Sum of Opacity of Glasses |
|---|---|---|---|---|
| Solid Detergent Control | 1000 | 0 | 17 | 393,210 |
| Liquid Detergent 1 | 1000 | 0 | 17 | 94,065 |
| Liquid Detergent 2 | 1000 | 8 | 17 | 48,745 |
| Liquid Detergent 3 | 1000 | 40 | 17 | 61,790 |
| Liquid Detergent 4 | 1000 | 20 | 17 | 276,170 |
| Liquid Detergent 5 | 1000 | 5 | 17 | 247,270 |
| Solid Detergent 6 | 1000 | 0 | 17 | 132,289 |

Table 7 shows that the liquid detergent compositions of the present disclosure performed significantly better than the control formulation, the formulation without calcium carbonate scale inhibitors, and the comparable commercial formulation in preventing calcium carbonate accumulation on both plastic and glass. The formulations of the disclosure also demonstrated surprisingly improved performance even in the absence of additional water conditioning agents/polymers. These results are further shown in FIGS. 1, 8-9, and 11.

The tetrapolymer evaluated in this Example and also in Example 1 comprises a blend of maleic acid, maleic anhydride, acrylic acid, and an alkane (decarboxylated monomer). Maleic acid, acrylic acid, and maleic anhydride are each individually used to address the problem of scale formation. However, there was no expectation of success or superior results in using a tetrapolymer incorporating polymerized monomers of all of maleic acid, acrylic acid, maleic anhydride, and an alkane. At most, it was expected that the tetrapolymer would perform no better than other acrylic acid or maleic acid polymers.

However, it was surprising that the tetrapolymer of the compositions performed substantially better than other polymers, particularly at such low concentrations. The exemplary compositions performed substantially better than control compositions at half the concentration of the control compositions. The exemplary compositions also performed substantially similar to control compositions at one quarter the concentration of the control compositions. In situations where the risk of scaling is particularly severe, the exemplary compositions can provide substantially improved performance at just 50% of the concentration of existing commercial products.

Excellent, industry standard performance can therefore be achieved at just 25% of the concentration of existing commercial products while substantial improvements can be achieved at a 50% concentration. Achieving industry standard performance at a much lower concentration beneficially reduces materials costs and permits more concentrated formulations to be prepared. Further, as less product is required to achieve excellent scale inhibition results, the detergent composition and dispenser have greater longevity. The embodiments being thus described, it will be obvious that the same may be varied in many ways. Such variations are not to be regarded as a departure from the spirit and scope of the disclosure and all such modifications are intended to be included within the scope of the following claims.

What is claimed is:

1. A scale inhibiting detergent composition comprising:

one or more sources of alkalinity;

one or more surfactants; and a scale inhibiting polymer consisting of a maleic acid tetrapolymer, and optionally one or more polycarboxylic acid homopolymers.

2. The composition of claim 1, wherein the one or more sources of alkalinity are sodium hydroxide, potassium hydroxide, lithium hydroxide, sodium silicate, sodium metasilicate, potassium silicate, potassium metasilicate, sodium carbonate, potassium carbonate, sodium bicarbonate, potassium bicarbonate, sodium sesquicarbonate, potassium sesquicarbonate, sodium borate, potassium borate, or a combination thereof.

3. The composition of claim 1, further comprising one or more water conditioning agents, wherein the one or more water conditioning agents are phosphates, phosphonates, aminocarboxylic acids, inorganic water conditioning agents, or a combination thereof.

4. The composition of claim 1, wherein the maleic acid tetrapolymer includes over 50% maleic acid, up to about 5% of maleic anhydride, up to about 50% of acrylic acid, and up to about 50% of a 2-carbon alkane group.

5. The composition of claim 1, further comprising a carrier, wherein the carrier is water, an alcohol, a water-soluble diol, or a combination thereof.

6. The composition of claim 1, wherein the surfactant is a nonionic surfactant.

7. The composition of claim 6, wherein the nonionic surfactant is a polyoxyethylene-polyoxypropylene block copolymer.

8. The composition of claim 5, wherein the carrier is water, and wherein the water is present in an amount of between about 10 wt.% to about 60 wt.%.

9. The composition of claim 1, further comprising one or more additional functional ingredients, wherein the additional function ingredients are fillers, additional surfactants, corrosion inhibitors, hardening agents, bleaching agents, defoaming agents, anti-redeposition agents, stabilizing agents, dispersants, enzymes, thickeners, fragrances, dyes, or a combination thereof.

10. A scale inhibiting detergent composition comprising:

between about 5 wt.% to about 80 wt.% of one or more sources of alkalinity;

between about 5 wt.% to about 50 wt.% of a nonionic surfactant; and a scale inhibiting polymer consisting of a maleic acid tetrapolymer and optionally one or more polycarboxylic acid homopolymers, wherein the composition comprises between about 1 wt.% to about 15 wt.% of the maleic acid tetrapolymer, and wherein the maleic acid tetrapolymer includes over 50% maleic acid, up to about 5% of maleic anhydride, up to about 50% of acrylic acid, and up to about 50% of a 2-carbon alkane group.

11. The composition of claim 10, further comprising between about 0.001 wt.% to about 5 wt.% of a corrosion inhibitor, wherein the corrosion inhibitor is sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, zinc salicylate or a combination thereof.

12. The composition of claim 10, wherein the nonionic surfactant is a polyoxyethylene-polyoxypropylene block copolymer.

13. The composition of claim 10, further comprising between about 0.01 wt.% to about 8 wt.% of a carrier, and wherein the carrier is water, ethanol, n-propanol, isopropanol, pentylene glycol, hexylene glycol, propylene glycol or a combination thereof.

14. The composition of claim 10, further comprising between about 0.5 wt.% to about 10 wt.% of a filler, wherein the filler is sodium sulfate, sodium chloride, a starch, a sugar, a $C_1$-$C_{10}$ alkylene glycol, or a combination thereof, and/or between about 1 wt.% to about 55 wt.% of the polycarboxylic acid homopolymers.

15. The composition of claim 10, wherein the composition is a pressed solid, a cast solid, an extruded solid, or a flowable solid.

16. The composition of claim 10, wherein the composition is a liquid concentrate.

17. The composition of claim 16, wherein the liquid concentrate is diluted to form a use solution.

18. A method of preventing scale formation on a surface comprising:

providing a scale inhibiting composition comprising one or more sources of alkalinity; one or more water conditioning agents; and a scale inhibiting polymer; and contacting the scale inhibiting composition with a surface, wherein the scale inhibiting polymer is a maleic acid tetrapolymer, and wherein the water conditioning agents are phosphates, phosphonates, aminocarboxylic acids, inorganic water conditioning agents, polycarboxylic acids, polycarboxylic acid homopolymers, or a combination thereof.

19. The method of claim 18, wherein the surface comprises metal, plastic, and/or glass.

20. The method of claim 18, wherein the surface is a hard surface comprising a grill, oven, dishware, flatware, surgical instrument, vehicle, floor, countertop, table, or a combination thereof.

* * * * *